US010144492B1

(12) United States Patent
Liu

(10) Patent No.: US 10,144,492 B1
(45) Date of Patent: Dec. 4, 2018

(54) AIR BAG STRUCTURE

(71) Applicant: Tsung Hsi Liu, Yilan County (TW)

(72) Inventor: Tsung Hsi Liu, Yilan County (TW)

( * ) Notice: Subject to any disclaimer, the term of this patent is extended or adjusted under 35 U.S.C. 154(b) by 0 days.

(21) Appl. No.: 15/891,361

(22) Filed: Feb. 7, 2018

(30) Foreign Application Priority Data

May 31, 2017 (TW) ..... 106207701 U

(51) Int. Cl.
*B63C 9/08* (2006.01)
*B63C 9/125* (2006.01)

(52) U.S. Cl.
CPC ..... *B63C 9/081* (2013.01); *B63C 9/1255* (2013.01)

(58) Field of Classification Search
CPC ..... B63C 9/081; B63C 9/1255; B63C 9/105; B63C 9/1055; B63C 9/082; B63C 9/087; B63C 9/093
USPC ..... 441/106
See application file for complete search history.

(56) References Cited

U.S. PATENT DOCUMENTS 8,595,864 B2 * 12/2013 Orita ..... A41D 13/018 2/102
9,688,370 B1 * 6/2017 Shiue ..... B63C 9/1255
2004/0002270 A1 * 1/2004 Courtney ..... B63C 9/0005 441/40
2006/0043712 A1 * 3/2006 Hakki ..... B60R 19/205 280/735
2009/0058048 A1 * 3/2009 Ishida ..... B60R 21/20 280/728.2

* cited by examiner

*Primary Examiner* — S. Joseph Morano
*Assistant Examiner* — Jovon E Hayes
(74) *Attorney, Agent, or Firm* — Chun-Ming Shih

(57) ABSTRACT

An air bag structure includes an air bag body. The air bag body includes a first air bag, a second air bag, and an intermediate partition disposed between the first air bag and the second air bag. The intermediate partition is extensible. When one of the air bags is broken, the other air bag is inflated. The intermediate partition is deformed to move toward the rupture, and the air volume of the good air bag is doubled and returned to the original air volume, thereby maintaining buoyancy.

8 Claims, 4 Drawing Sheets

AIR BAG STRUCTURE

FIELD OF THE INVENTION

The present invention relates to an air bag structure, and more particularly to an air bag structure having a filling function. The air bag structure may be applied to a life jacket. When a partial structure is broken, the air bag structure is able to restore the volume of the air bag in a filling way, thereby maintaining buoyancy.

BACKGROUND OF THE INVENTION

Water activities are one of leisure activities that people loves to do, such as swimming, surfing or driving sails. The most worrying thing about water activities is the safety. When someone falls into the water and waits for rescue, if there is no ideal auxiliary life-saving equipment, the drowning person may be in a state of exhaustion even if he/she has skills in swimming. Therefore, it is necessary to wear a life jacket for water sports. A common life jacket having Styrofoam is inconvenient for surfing activities due to the internal Styrofoam material. In recent years, a life jacket is developed, which has a built-in air bag and a compressed air cylinder. In normal use, the air bag is not inflated, so the life jacket is thin and won't impede human activities. Once the user falls into the water and waits for rescue, the compressed air in the air cylinder can be poured into the air bag to provide buoyancy so that the user is buoyant on water. However, if the air bag is broken by a reef, a rock or the like, this kind of life jacket will decrease or loss buoyancy to cause a danger.

Accordingly, the inventor of the present invention has devoted himself based on his many years of practical experiences to solve these problems.

SUMMARY OF THE INVENTION

In view of the shortcomings of the prior art, the primary object of the present invention is to provide an air bag structure. The air bag structure comprises an air bag body. The air bag body comprises a first air bag, a second air bag, and an intermediate partition disposed between the first air bag and the second air bag. The intermediate partition is extensible. When one of the air bags is broken, the other air bag is inflated. The intermediate partition uses its extensibility to be deformed toward the rupture, and the air volume of the good air bag is doubled and returned to the original air volume, thereby maintaining buoyancy and extending the rescue time to ensure the safety of the user.

In order to achieve the aforesaid object, the air bag structure of the present invention comprises an air bag body disposed in a life jacket. The air bag body comprises a first outer cladding, an intermediate partition, and a second outer cladding. The intermediate partition is disposed between the first outer cladding and the second outer cladding. The edges of the first outer cladding, the intermediate partition and the second outer cladding are sealed by pressing, so that a first air bag is formed between the first outer cladding and the intermediate partition, and a second air bag is formed between the second outer cladding and the intermediate partition.

A very important feature of the present invention is that the material area of the intermediate partition is greater than that of each of the first outer cladding and the second outer cladding. That is, the intermediate partition is extensible. In principle, if the second air bag is not inflated, the first air bag is inflated and the intermediate partition is deformed to move toward the second outer cladding, that is, the volume of the first air bag becomes a volume containing the volume of the original second air bag. In other words, when any one of the air bags is broken, the other air bag is inflated to restore the original volume, thereby maintaining buoyancy.

The first outer cladding is provided with a first air inlet. The first air inlet is connected with a first air cylinder. The first air cylinder is configured to supply air. The first air inlet may be input air by a user's mouth.

The second outer cladding is provided with a second air inlet. The second air inlet is connected with a second air cylinder. The second air cylinder is configured to supply air. The second air inlet may be input air by a user's mouth.

DETAILED DESCRIPTION OF THE PREFERRED EMBODIMENTS

Embodiments of the present invention will now be described, by way of example only, with reference to the accompanying drawings.

Figure 1:
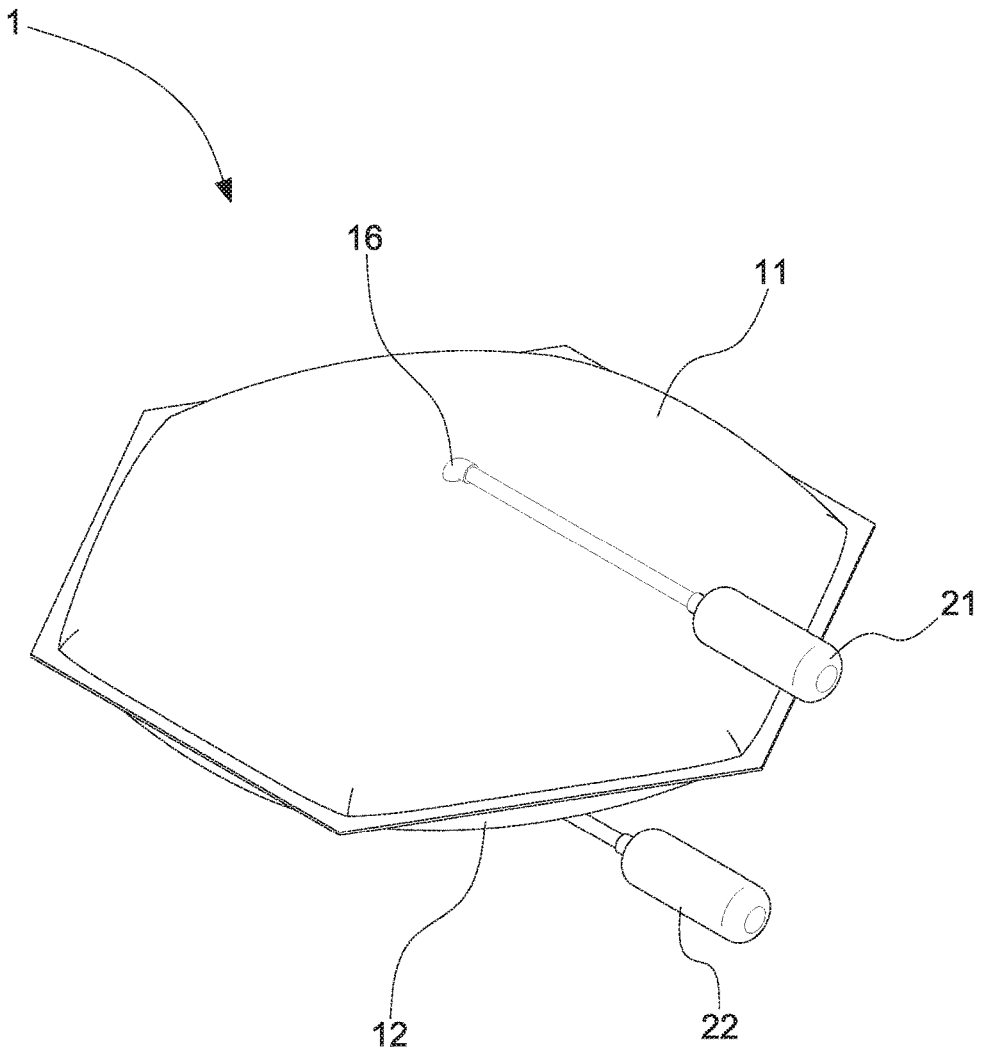
FIG. 1 is a perspective view of the present invention.
Figure 2:
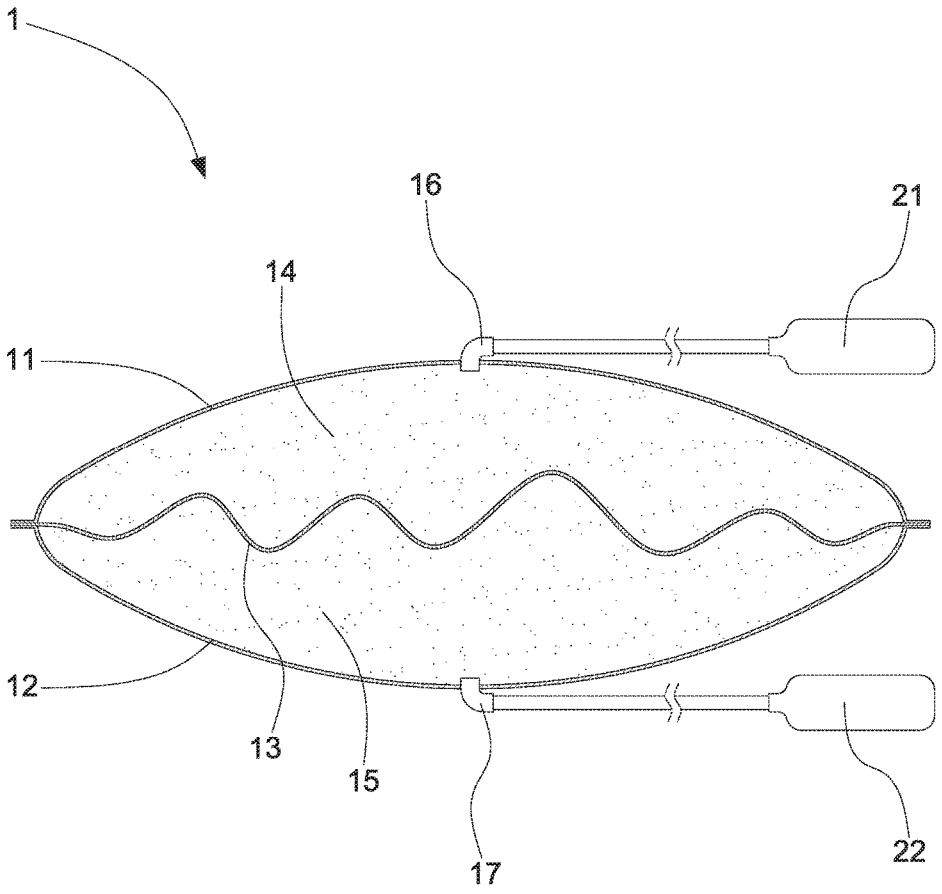
FIG. 2 is a sectional view of the present invention.

As shown in FIG. 1 and FIG. 2, the present invention discloses an air bag structure. The air bag structure comprises an air bag body 1 disposed in a life jacket. The air bag body 1 comprises a first outer cladding 11, an intermediate partition 13, and a second outer cladding 12. The intermediate partition 13 is disposed between the first outer cladding 11 and the second outer cladding 12. The edges of the first outer cladding 11, the intermediate partition 13 and the second outer cladding 12 are sealed by pressing, so that a first air bag 14 is formed between the first outer cladding 11 and the intermediate partition 13, and a second air bag 15 is formed between the second outer cladding 12 and the intermediate partition 13. A very important feature of the present invention is that the material area of the intermediate partition 13 is greater than that of each of the first outer cladding 11 and the second outer cladding 12. That is, the intermediate partition 13 is extensible.

The first outer cladding 11 is provided with a first air inlet 16. The first air inlet 16 is connected with a first air cylinder 21. The first air cylinder 21 is configured to supply air. The first air inlet 16 may be input air by a user's mouth. The second outer cladding 12 is provided with a second air inlet 17. The second air inlet 17 is connected with a second air cylinder 22. The second air cylinder 22 is configured to supply air. The second air inlet 17 may be input air by a user's mouth. The aforesaid air cylinder is a compressed air bottle. The compressed air capacity is sufficient for a single air bag to be inflated several times.

When the air bag body 1 is disposed in the life jacket, it is not inflated to facilitate the activities of the user. When the user falls into the water and waits for the rescue, the first air bag 14 and the second air bag 15 are inflated, as shown in FIG. 2, to provide buoyancy.

Figure 3:
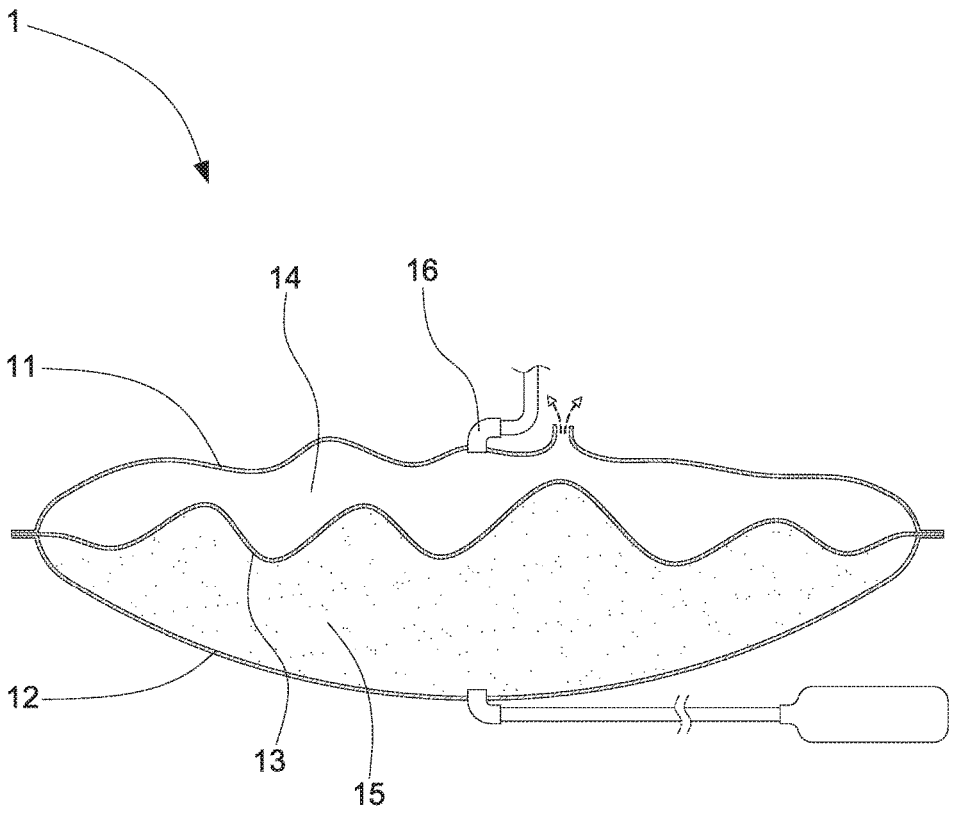
FIG. 3 is a schematic view of the present invention, showing that the first air bag is broken.

When the first outer cladding 11 is broken (as shown in FIG. 3), the first air bag 14 will malfunction, and the overall buoyancy of the air bag body 1 is only half of the original.

Figure 4:
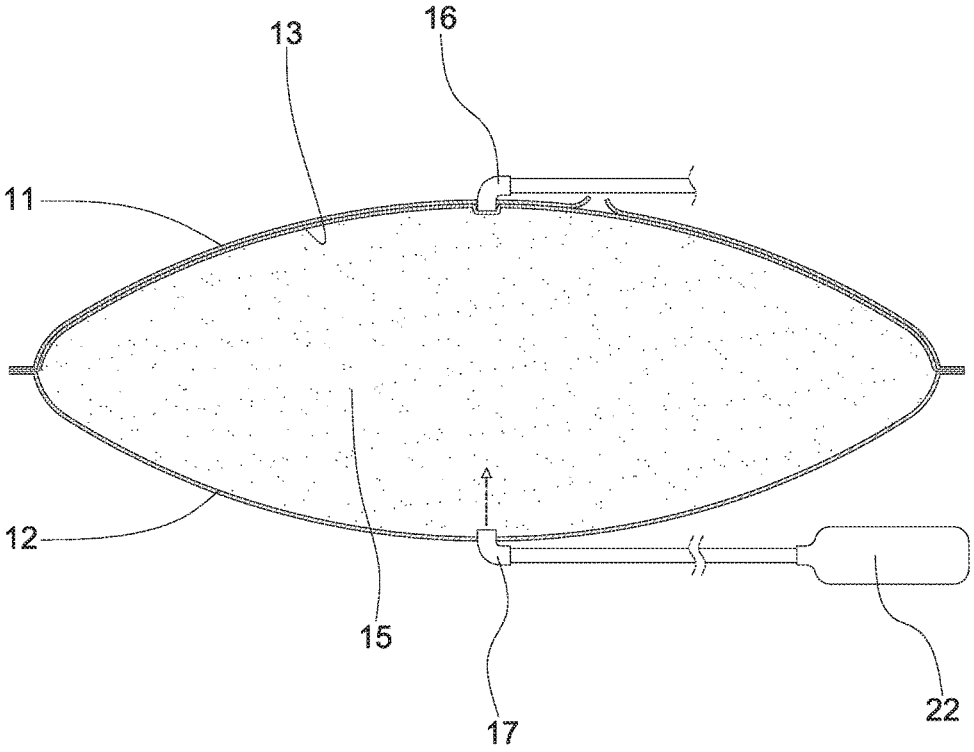
FIG. 4 is a schematic view of the present invention, showing that when the first air bag is broken, the second air bag is inflated to double the volume of the second air bag.

At this time, the second air bag 15 is inflated again. The intermediate partition 13 uses its extensibility to be deformed toward the rupture of the first outer cladding 11 (as shown in FIG. 4), and the air volume inside the second air bag 15 is doubled and returned to the original air volume, thereby maintaining buoyancy and extending the rescue time to ensure the safety of the user.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An air bag structure, comprising an air bag body, the air bag body comprising a first outer cladding, an intermediate partition and a second outer cladding, the intermediate partition being disposed between the first outer cladding and the second outer cladding; edges of the first outer cladding, the intermediate partition and the second outer cladding being sealed by pressing so that a first air bag is formed between the first outer cladding and the intermediate partition and a second air bag is formed between the second outer cladding and the intermediate partition; the intermediate partition having a material area greater than that of each of the first outer cladding and the second outer cladding, the intermediate partition being extensible, wherein when one of the first outer cladding and the second outer cladding is broken, the other air bag is inflated and the intermediate partition is deformable to move toward the broken outer cladding, thereby obtaining a double air bag volume.

2. The air bag structure as claimed in claim 1, wherein the first outer cladding is provided with a first air inlet.

3. The air bag structure as claimed in claim 2, wherein the first air inlet is connected with a first air cylinder.

4. The air bag structure as claimed in claim 2, wherein the first air inlet is configured to input air by a user's mouth.

5. The air bag structure as claimed in claim 1, wherein the second outer cladding is provided with a second air inlet.

6. The air bag structure as claimed in claim 5, wherein the second air inlet is connected with a second air cylinder.

7. The air bag structure as claimed in claim 5, wherein the second air inlet is configured to input air by a user's mouth.

8. The air bag structure as claimed in claim 1, wherein the air bag body is disposed inside a life jacket.

* * * * *